United States Patent [19]

Olešovský

[11] 4,028,926

[45] June 14, 1977

[54] HANDLING DEVICE FOR SLIPPING TUBES ON THE MANDREL OF BENDING MACHINES

[75] Inventor: Jaroslav Olešovský, Ricmanice, Czechoslovakia

[73] Assignee: Prvni Brnenska Strojirna, Narodni Podnik, Brno, Czechoslovakia

[22] Filed: Dec. 4, 1974

[21] Appl. No.: 529,463

[52] U.S. Cl. ..... 72/422; 72/311; 72/387; 294/86 R; 294/88; 294/106; 214/1 P

[51] Int. Cl.[2] ..... B21D 9/05; B21D 43/00; B25J 5/02; B65G 65/02

[58] Field of Search ..... 72/422, 387, 370, 293, 72/307, 311–316, 318, 418, 420, 419, 426, 150, 159; 214/1 P, 1 PA; 294/86 R, 86.16, 93, 97, 88, 106, DIG. 2

[56] References Cited

UNITED STATES PATENTS

| | | | |
|---|---|---|---|
| 799,670 | 9/1905 | Reynolds | 72/150 X |
| 1,662,428 | 3/1928 | Lowe | 72/150 |
| 2,359,167 | 9/1944 | Somes | 214/1 P |
| 2,604,220 | 7/1952 | Frischmann | 294/88 X |
| 2,683,546 | 7/1954 | Sherriff | 294/DIG. 2 |
| 2,708,378 | 5/1955 | Smith | 214/1 P |
| 3,055,513 | 9/1962 | Kralowetz | 214/1 P |
| 3,061,914 | 11/1962 | Johnston | 214/1 P |
| 3,061,916 | 11/1962 | Kretz | 29/252 X |
| 3,396,565 | 8/1968 | Miller | 72/389 X |
| 3,561,615 | 2/1971 | Forsberg | 214/1 P |
| 3,897,099 | 7/1975 | Scodino | 294/106 |

FOREIGN PATENTS OR APPLICATIONS

| | | | |
|---|---|---|---|
| 880,419 | 6/1953 | Germany | 72/419 |
| 1,101,911 | 3/1961 | Germany | 72/422 |
| 1,752,130 | 5/1973 | Germany | 72/422 |

*Primary Examiner*—C.W. Lanham
*Assistant Examiner*—D. M. Gurley
*Attorney, Agent, or Firm*—Burgess Ryan and Wayne

[57] ABSTRACT

A device for slipping a tube on the mandrel of a bending machine includes a support upon which a pair of slides are slidably mounted for movement in a direction parallel to the axis of the mandrel. A double arm lever is pivotally mounted to each slide, about axes parallel to the axis of the mandrel and a cylinder is mounted between the first ends of the levers. Gripping jaws are removably mounted to holders rotatably connected to the other ends of the levers, the gripping jaws being adapted to clamp a tube to be bent therebetween on opposite sides of the mandrel. A further cylinder is provided for moving the slides in a direction parallel to the axis of the mandrel.

4 Claims, 3 Drawing Figures

HANDLING DEVICE FOR SLIPPING TUBES ON THE MANDREL OF BENDING MACHINES

This invention relates to a handling device for slipping tubes on the mandrel of a bending machine, and for removing the tubes from the mandrel following a bending operation.

The slipping of tubes on the mandrel of a bending machine, according to prior procedures, is generally difficult and time-consuming, since for example, tubes having large dimensions are generally bent when they are in a cold state. To obtain a quality bend in a tube, it is necessary to employ mandrels of such diameter that there is a minimum clearance between the tube and the mandrel. In view of the minimum clearance, it is difficult to slip the tube onto the mandrel, and it is also difficult to remove the tube from the mandrel following a bending operation. Large manufacturing tolerances, permissible tolerances in eccentricity, and optical curvature of the tube often make it impossible to slip the tube onto the mandrel. The operation of slipping the tube onto the mandrel is generally a manual operation, in which cranes and levers may be employed for holding the tube, and in the past two operators have been required to perform a bending operation. Thus, slipping a long and heavy tube onto the mandrel requires great exertion on the part of the operators.

The present invention is directed to the provision of a device for eliminating the above disadvantages of prior art techniques of slipping of tubes onto a mandrel.

Briefly stated, in accordance with the invention, a device for slipping a tube onto the mandrel of a bending machine includes a clamping cylinder. A pair of levers, such as double arm levers, are pivotally connected to the suspension eyes on the two sides of the cylinder, and these levers are pivotally mounted to the slide rests. Swingable holder means are pivotally mounted to the other ends of the levers, and interchangeable gripping jaws are mounted on each of the holders. The gripping jaws are mounted to engage opposite sides of a tube to be slipped onto a mandrel.

In addition, a feeding cylinder is connected to a connecting plate affixed to the slide rest, in order to enable movement of the jaws in a direction parallel to the axis of the mandrel.

The handling device, in accordance with the invention, enables a single operator, operating a hydraulic system, to easily and readily slip a tube to be bent onto the mandrel. By employing the device in accordance with the invention, it is possible to employ mandrels having a minimum clearance with respect to the tube, so that the quality of the bends in a tube may be increased. In addition, the device minimizes the physical exertion of the operators required in the bending operation, increases the safety of the operation of bending a tube, and also increases the speed at which bending operations may be effected.

In order that the invention may be more clearly understood, it will now be described in greater detail with reference to the accompanying drawings, wherein.

Figure 1:
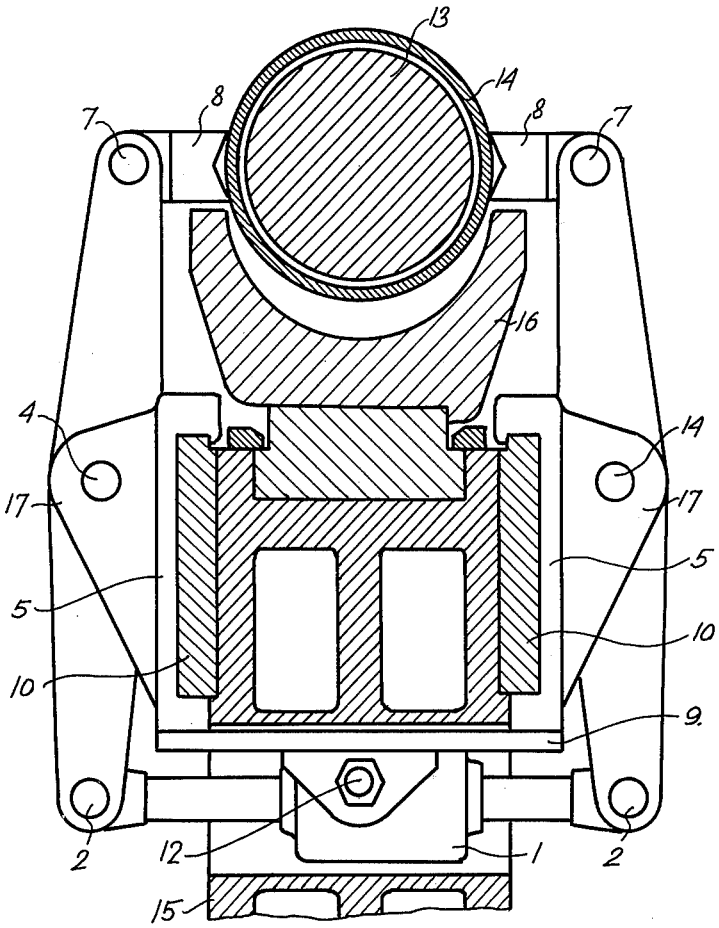
FIG. 1 is a cross-sectional view of a handling device in accordance with the invention, taken along the lines I — I of FIG. 2.
Figure 2:
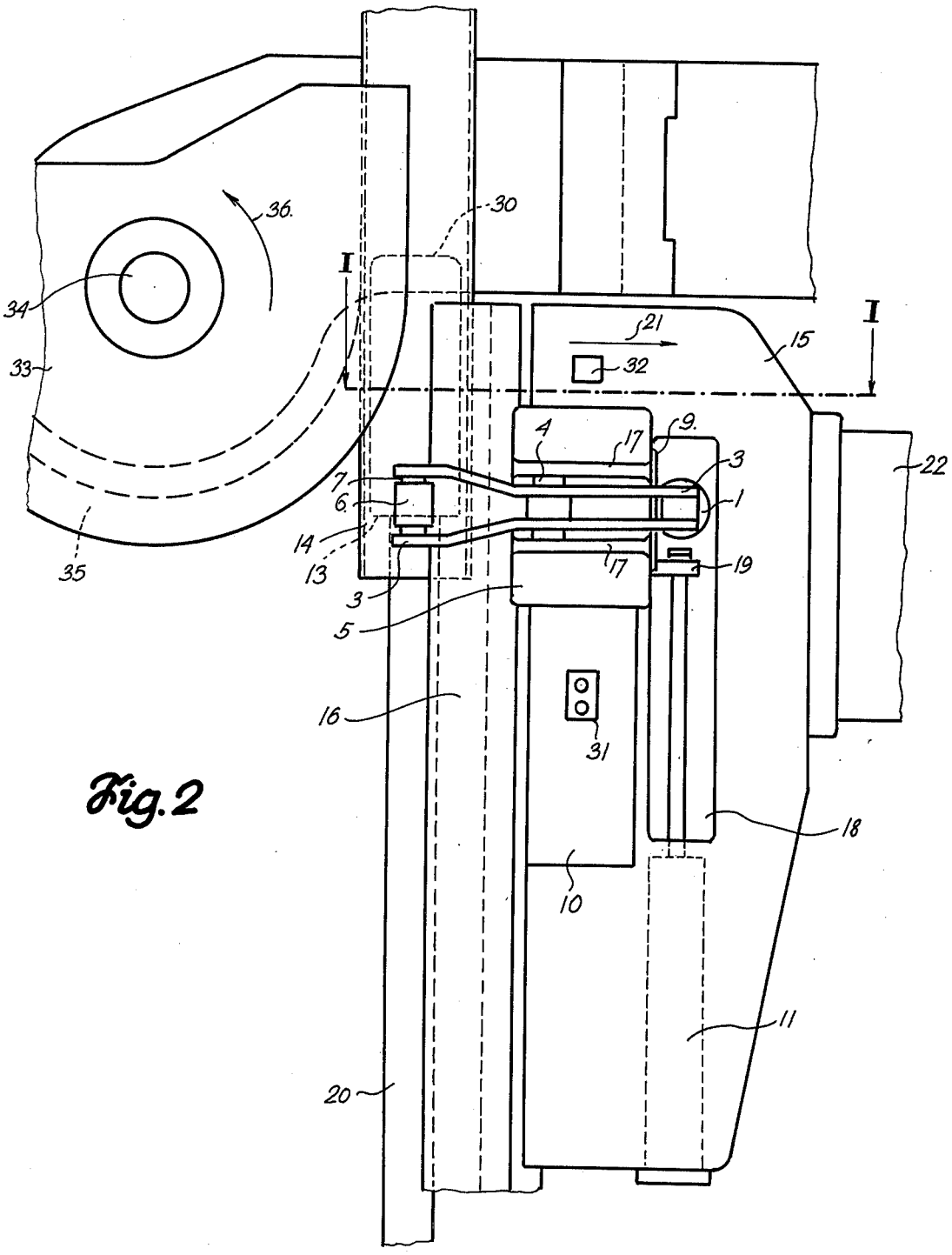
FIG. 2 is a side view of a handling device in accordance with the invention, and also illustrating partially a bending machine of the type with which the device of the present invention may be employed.

Referring now to the drawings, and more in particular, to FIGS. 1 and 2, a handling device in accordance with the invention comprises a clamping cylinder 1, such as a hydraulic cylinder. Mounting eyes on opposite ends of the cylinder are pivotally connected by pins 2 to separate levers 3. As illustrated in FIG. 2, the levers 3 may be formed as double levers. The levers 3 are pivotably mounted to brackets 17 of a pair of slide rests 5 by means of bolts 4, the pivotal axes of the levers being positioned between the ends of the levers. For example, as illustrated in FIG. 2, a pair of brackets 17 may be provided, spaced apart on each slide rest 5, with the two corresponding levers 3 being positioned in spaced-apart relationship between the respective brackets 17.

Rotatable holders 6 are pivotally mounted to the other ends of the levers 3 by means of connecting pins 7. A separate gripping jaw 8 is removably mounted on each of the holders 6, so that the gripping jaws 8 may be interchangeable in order to accommodate tubes to be bent of different diameters.

The slide rests 5 are slidably mounted on slide supports 10 mounted on opposite sides of a support member 15. As illustrated in FIG. 2, the support 15 may have a slot 18 aligned with the first ends of the levers. The slide rests 5 are interconnected by means of a connecting plate 9 extending through the slot 18, and the hydraulic cylinder 1 may be mounted in the slot 18 on the connecting plate 9. A second hydraulic cylinder 11 fixedly mounted with respect to the support 15, for example extending through a hole in the support 15, has a piston rod 12 extending into the slot 18 and connected to a bracket 19 affixed to the connecting plate 9. The hydraulic cylinder 11 thus moves the slide rests, and hence the levers and gripping jaws, slidably along the slide support 10. A mandrel 13 for bending a tube 14 is mounted, for example, on a mandrel support rod 20, as illustrated in FIG. 2. The pivotal axes of the levers 3, and the piston rod 12 extend parallel to the axis of the mandrel, and the slide rests 5 are adapted to slide on their slide supports 10 also in a direction parallel to the axis of the mandrel. The slide supports 10 thus extend parallel to the axis of the mandrel, so that it is guaranteed that the movement of the gripping jaws is parallel to the axis of the mandrel.

A mandrel guide 16 may be mounted on the support 15, extending parallel to the axis of the mandrel and spaced therefrom, in order to support the tube to be bent at a position displaced from the mandrel.

In order to adapt the device in accordance with the invention for the bending of tubes of different sizes, it is necessary to provide means for moving the support 15 in a direction normal to the axis of the mandrel, as indicated by the arrow 21 in FIG. 2. For this purpose, the support 15 may be mounted on a suitable column or arm 22, adapted to be moved in the direction of the arrow 21 by any suitable conventional means. This arrangement insures that the gripping jaws close correctly on the tube 14 along a diameter of the tube 14. In order to compensate for slight inaccuracies in the alignment of the gripping jaws and a diameter of the tube 14, the holders 6 for holding the gripping jaws are pivotally mounted to the respective ends of the levers 3. Thus, if a slight inaccuracy in the alignment arises, the gripping jaws, having v-shaped gripping faces, will easily slip into alignment as they engage the tube 14.

Figure 3:
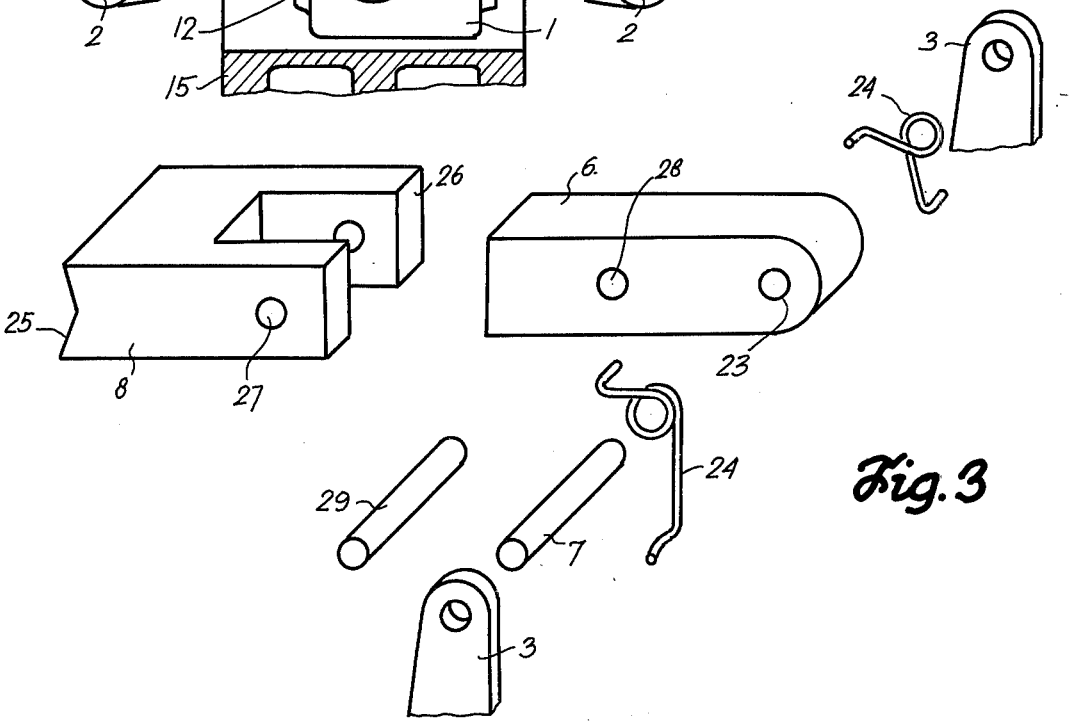
FIG. 3 is a perspective exploded view of the clamping jaw and holder assembly in accordance with one embodiment of the invention.

The holders 6 are also preferably resiliently mounted at their pivotal axes, in order to facilitate the gripping of the tube 14 when the gripping jaws are slightly out of alignment with the diameter of the tube 14. FIG. 3 illustrates one arrangement for thus mounting the holders 6. As illustrated in FIG. 3, the connecting pin 7 extends through an aperture 23 in one end of the holder 6, the pin 7 also extending through aligned apertures in the corresponding ends of the pair of arms 3. Suitable springs 24 are provided for resiliently holding the holder 6 at a determinable angle or position on the pin 7. For example, the springs 24 may be wire springs encircling the connecting pin 7 on opposite sides of the holder 6, with the ends of the springs being bent to engage the holder 6 and the arm 3 on the respective sides of the holder, to bias the holder 6 in opposite directions. It will be obvious, of course, that any other connection means may be employed for resiliently holding the holder 6 in position.

FIG. 3 also illustrates one embodiment of a gripping jaw 8 in accordance with the invention that may be removably affixed to the holder 6. The gripping jaw 8 has a gripping face 25, and the opposite end 26 of the gripping jaw 8 is bifurcated, so that it can slip over the holder 6. A hole 27 extends through the bifurcated end of the jaw 8, the hole 27 being alignable with a corresponding hole 28 through the holder 6. A pin or screw 29 is adapted to extend through the holes 27 and 28, to hold the gripping jaw in place. It will be obvious, of course, that any other conventional means may be employed for removably affixing the jaws to the holders 6.

It is apparent that the springs for holding the holders 6 serve to enable the deflection of the holders 6, so that they may be resiliently moved to correct alignment with the tube 14 upon gripping of the tube 14 by the jaws 8.

In operation of the device, referring to FIG. 2, the tube 14, which may be supported by a suitable crane (not shown), is moved to a position over the end 30 of the mandrel 13. The jaws 8 of the clamping device in accordance with the invention are closed against the tube 14, as illustrated in FIG. 1, by means of the hydraulic cylinder 1. In other words, the lower ends of the arms 3 are separated by means of the hydraulic cylinder 1, to force the gripping jaws 8 toward one another to grip the outside of the tube 14. Following the gripping of the tube 14 in this manner, the hydraulic cylinder 11 is actuated to move the gripping jaws, and hence the tube 14, in a direction parallel to the axis of the mandrel, thereby slipping the tube over the mandrel.

The slipping of the tube into place, in accordance with the invention, occurs in steps. For this purpose, a suitable limit switch, such as a microswitch 31 mounted on the slide support 10, is provided to be engaged by the slide rest 5. Thus, when the slide rest 5 has moved a determined extent in the direction parallel to the axis of the mandrel, it engages the switch 31. The switch 31 is connected to effect the release of the gripping jaws 8 by control of the hydraulic cylinder 1, and also to effect the return of the slide rests into a position remote from the switch 31 by suitable control of the hydraulic cylinder 11. The control of the hydraulic cylinders 1 and 11 by means of a switch 31 are conventional, and may include, for example, a solenoid switch controlled by the switch 31 for controlling the ignition and release of fluid from the ports of the hydraulic cylinders. A further switch may be provided which engages the slide rest at its starting position, as illustrated in FIG. 2, to enable the repeating of the gripping of the tube 14 by the jaws 8 and the movement of the slide rests toward the switch 31, so that the tube 14 may be automatically slipped in steps over the mandrel 13. For example, for this purpose a further microswitch 32 may be mounted, for example on the support 15, to engage the slide rest at its starting position. The slipping of the tube on the mandrel may thus be repeated in steps, until the necessary length of tube is slipped onto the mandrel 13.

In the arrangement in accordance with the invention, the tube is not clamped in the gripping jaws 8 of the handling device as a result of deformation of the tube during bending, the gripping only being effected by the means of operation of the hydraulic cylinder 1.

The automatic removal of the tube from the mandrel may be effected in a similar manner. In this case, the switches and hydraulic cylinders are conventionally intercoupled so that the jaws are closed onto the tube 14 when the limit position with the slide rests engaging the switch 31 is reached, and the jaws are released when the slide rest engages the microswitch 32.

The device in accordance with the invention may be conveniently operated by means of pushbuttons (not illustrated) on a suitable panel, either for single step operation or operation in accordance with an automatic cycle. Conventional circuits and control systems may be employed for this purpose.

In order to more clearly show the operation of the device in cooperation with a bending machine, a portion of a conventional bending machine is illustrated in FIG. 2. The bending machine may be comprised of a bending die 33 mounted for rotation about an axis 34, the bending die having a suitable curved bending surface 35 which engages the sides of the tube 14 opposite the handling device in accordance with the invention upon rotation in the direction illustrated by the arrow 36. Bending machines of this type are, of course, conventional.

While the invention has been disclosed and described with reference to a single embodiment, it will be apparent that modifications and variations may be made therein within the teaching of the invention, and it is, therefore, intended in the following claims to cover each such variation and modification as follows within the true spirit and scope of the invention.

What is claimed is:

1. A device for slipping a tube to be bent on the mandrel of a bending machine, said device comprising support means, a pair of slide means slidably mounted on opposite sides of said support means for movement in a direction parallel to the axis of said mandrel, a lever pivotally mounted on each of said slide means about axes parallel to said axis, first cylinder means connected between first ends of each of said levers for moving said first ends of said levers in directions perpendicular to the axis of said mandrel independently of the movement of the slide means, a pair of gripping jaws, holder means for mounting a separate one of said gripping jaws to the other end of each of said levers, said holder means being pivotally connected to said other ends of said levers for movement about axes parallel to the axis of said mandrel independently of the pivotal motion of said levers, second cylinder means for moving said slide means in said direction, and further comprising spring means for resiliently bidirectionally biasing said holder means towards determined angular positions with respect to said other ends of said levers, thereby restricting pivotal motion of the jaws and the holder means about said other ends of said levers, said gripping jaws being removably affixed to said holder means.

2. The device of claim 1, further comprising a connection plate for interconnecting said slide means.

3. The device of claim 1, wherein said support means is mounted for movement in a direction normal to said axis of said mandrel.

4. The device of claim 1, further comprising limit switch means on said support means and coacting with said first and second cylinder means for actuating said first and second cylinder means to sequentially effect a gripping of said tube by said gripping jaws, a movement of said slide means and gripped tube in said direction, and a releasing of said tube by said gripping jaws.

* * * * *